US008590249B1

(12) United States Patent
Loper et al.

(10) Patent No.: US 8,590,249 B1
(45) Date of Patent: Nov. 26, 2013

(54) CLIP FOR COUPLING AND MOUNTING SIDING COURSES

(75) Inventors: Thomas Loper, Wilbraham, MA (US); David Bilodeau, Hadley, MA (US)

(73) Assignee: Jain (Americas) Inc., Columbus, OH (US)

( * ) Notice: Subject to any disclaimer, the term of this patent is extended or adjusted under 35 U.S.C. 154(b) by 619 days.

(21) Appl. No.: 12/703,222

(22) Filed: Feb. 10, 2010

Related U.S. Application Data

(60) Provisional application No. 61/157,927, filed on Mar. 6, 2009.

(51) Int. Cl.
*E04D 1/34* (2006.01)
*E04B 2/30* (2006.01)

(52) U.S. Cl.
USPC ..... 52/547; 52/489.2; 52/285.3

(58) Field of Classification Search
USPC ..... 52/489.1, 489.2, 543, 546, 547, 235, 52/281, 285.3, 511, 513, 586.1, 506.08
See application file for complete search history.

(56) References Cited

U.S. PATENT DOCUMENTS

| | | | | |
|---|---|---|---|---|
| 2,292,984 | A | 8/1942 | Alvarez, Jr. | |
| 3,738,076 | A | 6/1973 | Kessler | |
| 3,999,348 | A | 12/1976 | Hicks | |
| 4,698,942 | A | 10/1987 | Swartz | |
| D316,810 | S | 5/1991 | Blackford | |
| 5,564,245 | A | 10/1996 | Rademacher | |
| 5,575,127 | A | 11/1996 | O'Neal | |
| 6,050,041 | A | 4/2000 | Mowery et al. | |
| 6,055,787 | A | 5/2000 | Gerhaher et al. | |
| 6,289,646 | B1 | 9/2001 | Watanabe | |
| 6,598,362 | B2 | 7/2003 | Hikai | |
| 7,225,592 | B2 | 6/2007 | Davis | |
| 7,383,669 | B2 | 6/2008 | Morse | |
| 7,434,329 | B2 | 10/2008 | Walda | |
| 2002/0174618 | A1 | 11/2002 | Carroll | |
| 2008/0010922 | A1 * | 1/2008 | Wagner | 52/235 |
| 2009/0094914 | A1 * | 4/2009 | Jambois et al. | 52/273 |

FOREIGN PATENT DOCUMENTS

| | | |
|---|---|---|
| JP | 2002047781 | 2/2002 |

* cited by examiner

*Primary Examiner* — William Gilbert
(74) *Attorney, Agent, or Firm* — Roger A. Gilcrest

(57) ABSTRACT

A clip for coupling and mounting courses, such clip comprising a longitudinally extending upper support member coterminous with a longitudinally extending lower support member. The clip further comprises a longitudinally extending cavity formed between a front side and a rear side of the lower support member, wherein a top edge of a second course is secured within the cavity. The clip further comprises a longitudinally extending tongue member coterminous with a front side of the upper support member and separated therefrom by a groove. At least a portion of the tongue member fits within a groove of a first course. Additionally, a tongue member of the first course fits within the groove of the clip.

11 Claims, 3 Drawing Sheets

CLIP FOR COUPLING AND MOUNTING SIDING COURSES

CROSS REFERENCE TO RELATED APPLICATIONS

This application claims the benefit of U.S. Provisional Application No. 61/157,927 filed on Mar. 6, 2009.

BACKGROUND OF THE INVENTION

1. Field of the Invention

The present invention relates generally to the attachment of siding to a building, and more particularly to an improved siding clip for coupling and mounting courses to a vertical support.

2. Background of the Invention

A popular form of plastic siding is made to resemble clapboard, and typically includes a number of elongated pieces or courses which are applied in overlapping relationship, similar to clapboards, so as to shed water. Since the plastic siding is made of thin material, means must be provided to interlock each course as it is applied with the next lower course. For this purpose, an integral top locking strip is provided on each course which has a downward projection spaced from the body of the siding into which an upturned projecting strip on the bottom of the next higher course of siding can be fitted when applying the siding to a building structure, e.g., a house. This next course is then nailed to the house, usually to plywood sheathing which has been applied to form the exterior walls of the building structure, at a point above the top locking strip, so that the nailing is concealed by the next higher course of siding. The nailing is usually done through a slot provided near the top edge of each course of siding, the purpose of the slot being to permit a certain amount of lateral movement of the siding with respect to the wall of the house, and to provide for differential expansion and contraction between the siding and the sheathing which otherwise would tend to produce buckling and distortion of the siding. For this reason, the nail should not be applied too tightly, and this is often difficult to achieve in practice, and may result in the undesired distortion taking place.

Accordingly, what is needed is a clip that can securely fix siding courses to a vertical support wherein such clip will allow the courses to naturally expand and contract without affecting the functionality of the courses. The clip preferably should also be easily moved relative to the courses so that a stable vertical support, e.g., a wall stud, suitable for securement of the clip thereto, may be readily available.

BRIEF SUMMARY OF THE INVENTION

The above-discussed drawbacks and deficiencies of the prior art are eliminated by a clip for coupling and mounting courses, such clip comprising a longitudinally extending upper support member coterminous with a longitudinally extending lower support member. The clip further comprises a longitudinally extending cavity formed between a front side and a rear side of the lower support member, wherein a top edge of a second course is secured within the cavity. The clip further comprises a longitudinally extending tongue member coterminous with a front side of the upper support member and separated therefrom by a groove. At least a portion of the tongue member fits within a groove of a first course. Additionally, a tongue member of the first course fits within the groove of the clip. The courses may be further engaged with each other by fitting a foot rabbet of the first course into a head rabbet of the second course. Additionally, the clip may be secured to a vertical support, such as a wall stud, by driving a fastening member, such as a nail, through a body of the upper support member of the clip.

DETAILED DESCRIPTION OF THE INVENTION

Figure 1:
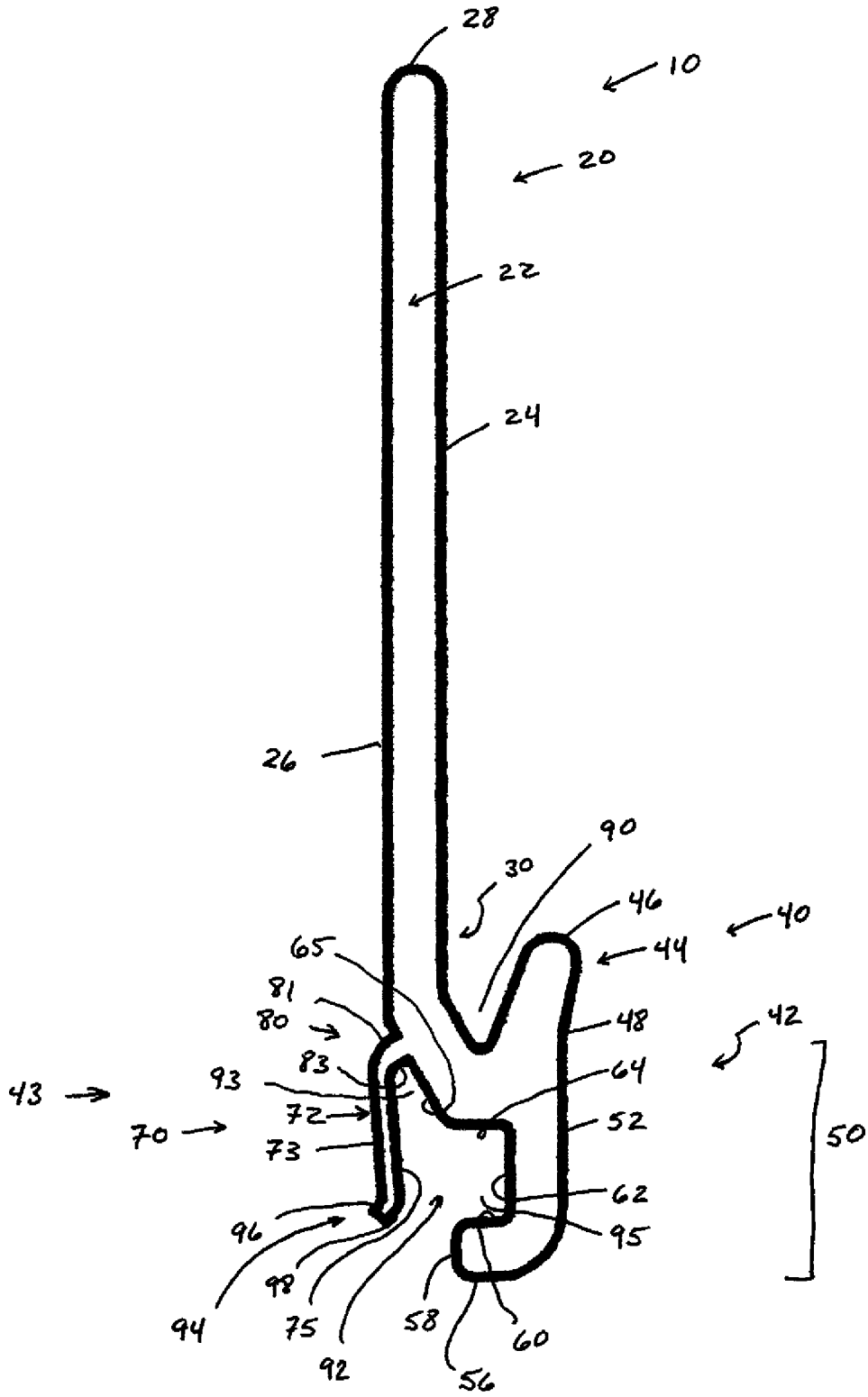
FIG. 1 is a schematic depicting a profile view of an exemplary siding clip.
Figure 2:
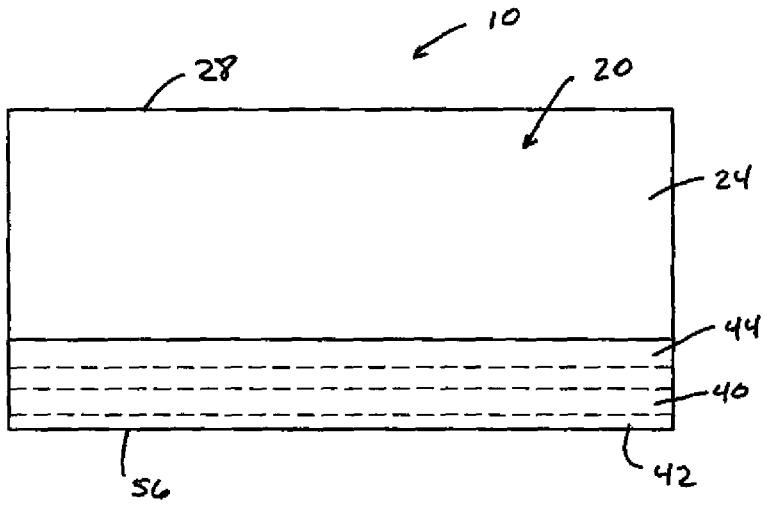
FIG. 2 is a schematic depicting a view from a front side of the siding clip depicted in FIG. 1.

Referring to FIGS. 1 and 2, an exemplary clip 10 comprises a longitudinally extending upper support member 20 contiguous with a longitudinally extending lower support member 40. Upper support member 20 comprises a longitudinally extending planar body 22 having a front side 24 opposite to a rear side 26, and a top edge 28 defining an uppermost portion of clip 10.

Lower support member 40 extends contiguously from a lower end 30 of planar body 22 of upper support member 20, and comprises a longitudinally extending front side 42 opposite to a longitudinally extending rear side 43. Formed on front side 42 and forwardly protruding therefrom is a longitudinally extending tongue member 44. Tongue member 44 turns upwardly from lower end 30 and extends towards top edge 28 of upper support member 20. Additionally, tongue member 44 is separated from front side 24 of upper support member 20 by a front side positioned groove 90. Tongue member 44 has as its apex a slightly forward curved, longitudinally extending tip 46 which defines the forward most portion of clip 10. Extending downward from tip 46 and slightly rearward thereof, is a longitudinally extending bottom portion 48 of tongue member 44.

Coterminous with bottom portion 48 of tongue member 44 and formed on front side 42 and rear side 43 of lower support member 40 is a longitudinally extending retaining portion 50. Retaining portion 50 comprises a longitudinally extending planar front wall 52 coterminous with bottom portion 48 of tongue member 44, and which extends along the length of front side 42.

Retaining portion 50 further comprises a longitudinally extending exterior bottom wall 56, which forms the lowermost portion of clip 10 and which is contiguously joined to a longitudinally extending terminal end of front wall 52 such that exterior bottom wall 56 runs rearward of front side 42 and towards front side 24 of upper support member 20. Just short of being coaxial with front side 24 of upper support member 22, exterior bottom wall 56 turns upward to form a longitudinally extending exterior abutment wall 58, then turns forward to form a longitudinally extending interior bottom wall 60, then turns upward to form a longitudinally extending interior forward directed wall 62, and then turns rearward to form a longitudinally extending interior upper wall 64. Contiguous with interior upper wall 64 is a longitudinally extending interior sloped wall 65 which slopes upwardly towards rear side 26, and which terminates at a longitudinally extending anterior step member 80, wherein anterior step member 80 slopes downwardly from and is contiguous with rear side 26 of upper support member 20. Anterior step member 80 comprises a longitudinally extending, downward sloped exterior wall 81 opposite to a longitudinally extending, downward sloped interior wall 83.

Retaining portion 50 further comprises a longitudinally extending fin 70. Fin 70 is configured to allow for optimum flexibility of fin 70 such that fin 70 can best accommodate manufacturing variations in the thickness of a top portion 120 of a course 100. As depicted in FIG. 1, fin 70 comprises a longitudinally extending planar member 72 extending rearward of rear side 26 of upper support member 20. Planar member 72 comprises a longitudinally extending exterior face 73 contiguous with exterior wall 81 of step member 80, and a longitudinally extending interior face 75 contiguous with interior wall 83 of step member 80.

A longitudinally extending posterior step member 94 is coterminous with a terminal end of planar member 72. Posterior step member 94 comprises a longitudinally extending top surface 96 which is coterminous with and slopes downward from exterior face 73 of planar member 72, and further comprises a longitudinally extending bottom surface 98 which is coterminous with and slopes downward from interior face 75. Posterior step member 94 terminates at a point approximately coplanar with interior bottom wall 60 of retaining portion 50.

Interior face 75, anterior step member interior wall 83, interior sloped wall 65, interior upper wall 64, interior forward directed wall 62, interior bottom wall 60, and exterior abutment wall 58 are all joined and configured to form a longitudinally extending cavity 92, wherein cavity 92 comprises a longitudinally extending rearward directed channel 93 formed between interior face 75, interior wall 83, and interior sloped wall 65, and a longitudinally extending forward directed channel 95 formed between interior upper wall 64, interior forward directed wall 62, and interior bottom wall 60.

Figure 3:
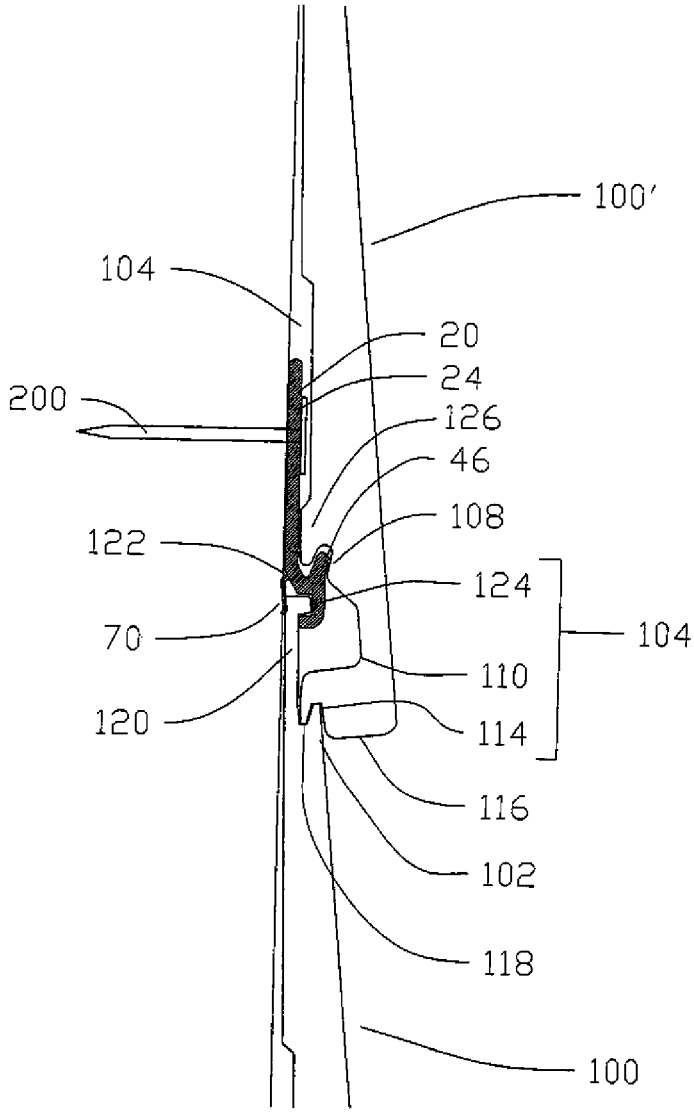
FIG. 3 is a schematic depicting an exemplary system comprising an exemplary siding clip in combination with exemplary courses.

Referring to FIG. 3, an exemplary application of clip 10 is in the placement and securement of courses onto a vertical structure, such as a wall. Here, a course 100 is coupled to a course 100' via clip 10. More particularly, courses 100 and 100' each comprises a front side 102 opposite to a back side 104. Formed on back side 104 towards a bottom portion 106 of each of courses 100 and 100' is an upwardly angled groove 108 and a groove 110, wherein groove 108 and groove 110 are coterminous with each other, and wherein groove 108 is also coterminous with a tongue member 126. A foot rabbet 114 is formed on back side 104 of a bottom edge 116 of each of course 100 and 100'. A head rabbet 118 is formed on front side 102. Extending from head rabbet 118 is a top portion 120 of the course which terminates at a top edge 122. Extending out toward front side 102 of top portion 120 located at top edge 122 is a protrusion 124.

When mounting the courses to a wall, clip 10 is positioned between two courses positioned in vertical alignment with each other. More particularly, referring to FIG. 3, front side 24 of upper support member 20 is disposed against back side 104 of course 100' such that tongue member 44 is at least partially disposed within upwardly angled groove 108, and such that tongue member 126 of course 100' is disposed within front side positioned groove 90. Groove 108 is configured and positioned to allow tongue member 44 to move in a vertical direction relative to groove 108 thereby facilitating vertical expansion between courses 100 and 100'. Top edge 122 and protrusion 124 of course 100 fit within cavity 92 and are held therein by interior face 75, interior wall 83, interior sloped wall 65, interior upper wall 64, interior forward directed wall 62, interior bottom wall 60, and exterior abutment wall 58. Course 100' is further engaged with course 100 by fitting head rabbet 118 of course 100 with foot rabbet 114 of course 100'.

The courses may be further secured to a vertical support by fixedly securing clip 10 to the vertical support. In an exemplary embodiment, a fastening member, e.g., a nail 200 may be driven through upper support member 20 of clip 10 and into, for example, a wall stud (not shown) prior to positioning of course 100' onto course 100.

Although the clip may be formed of a wide variety of materials, in an exemplary embodiment, the clip is formed from rigid poly vinyl chloride. The composition of the clip reduces the likelihood of bulging oil canning expansion at the seams.

The present invention has many advantages over the prior art. For example, as would be appreciated by those of skill in the art based on the present disclosure, the clip may be easily moved relative to the course and positioned over a stud. Additionally, as the fastening member is driven, not into the course itself, but into the clip, concern that the fastening member will be driven too tightly into the course, thereby causing buckling and distortion of the course, is alleviated. Also, the fin of the clip, along with the retaining groove, are configured to hold the clip onto the previously installed course to facilitate installation. The fin is further configured to optimize its flexibility so that is can accommodate a variety of sized courses. Additionally, the retaining groove of the clip provides additional retention of the courses to the wall. The tongue member of the clip and course groove clearance (e.g., the clearance provided by front side positioned groove 90) is configured to provide course expandability in a vertical direction. Additionally, the clip supports the next course.

Although the principles of the present invention have been illustrated and explained in the context of certain specific embodiments, it will be appreciated by those of skill in the art that various modifications beyond those illustrated can be made to the disclosed embodiment without departing from the principles of the present invention.

What is claimed is:

1. A clip for use in coupling a first course having a first exposed face and a groove, to a second course having a second exposed face and a top edge, in such a way that said first exposed face is disposed above said second exposed face, wherein the clip comprises:

an upper support member comprising a planar body having a longitudinally extending flat front side opposite to a longitudinally extending flat rear side, and a longitudinally extending top edge opposite to a longitudinally extending bottom edge; and a lower support member coterminous with the upper support member and comprising a longitudinally extending front side opposite to a longitudinally extending rear side, and further comprising:

a longitudinally extending cavity formed between the front side of the lower support member and the rear side of the lower support member, wherein said cavity is adapted to secure said top edge of the second course within it; and a longitudinally extending tongue member, wherein the tongue member is coterminous with the front side of the upper support member and is separated therefrom by a longitudinally extending groove and said longitudinally extending flat front side forming a portion of the boundary of said longitudinally extending groove;

wherein at least a portion of said tongue member is adapted to be received by said groove of the first course, such that said tongue member of the first course fits within the groove of the clip.

2. The clip of claim 1, further comprising a fin, wherein the fin comprises a planar member which is positioned rearward of the rear side of the upper support member, and which comprises a longitudinally extending exterior face opposite to a longitudinally extending interior face.

3. The clip of claim 2, wherein the fin is coterminous with a longitudinally extending anterior step member, wherein the anterior step member is also coterminous with the rear side of the upper support member such that the anterior step member slopes downward from the rear side of the upper support member towards the fin.

4. The clip of claim 2, wherein the lower support member further comprises a longitudinally extending front wall which is coterminous with the tongue member and which runs parallel to the planar body of the upper support member, and a longitudinally extending exterior bottom wall which is coterminous with the front wall of the lower support member and which runs rearward thereof and towards the front side of the planar body, wherein the exterior bottom wall forms a lowermost portion of the clip.

5. The clip of claim 4, wherein the exterior bottom wall turns upwardly towards the top edge of the upper support member to form a longitudinally extending exterior abutment wall, wherein the exterior abutment wall turns forward towards the front wall of the lower support member to form a longitudinally extending interior bottom wall, wherein the interior bottom wall turns upwards towards the top edge of the upper support member to form a longitudinally extending interior forward directed wall, wherein the interior forward directed wall turns rearward towards the fin to form a longitudinally extending interior upper wall, wherein the interior upper wall turns upwards towards the top edge of the upper support member to form a longitudinally extending interior sloped wall, wherein the interior sloped wall terminates at the anterior step member.

6. The clip of claim 5, wherein the interior sloped wall slopes upwardly from the interior upper wall towards the anterior step member.

7. The clip of claim 5, wherein the fin terminates at a point approximately coplanar with the interior bottom wall of the lower support member.

8. The clip of claim 7, wherein the cavity comprises a longitudinally extending rearward directed channel bordered by the fin, the anterior step member, and the interior sloped wall.

9. The clip of claim 8, wherein the cavity further comprises a longitudinally extending forward directed channel bordered by the interior upper wall, the interior forward directed wall, and the interior bottom wall.

10. The clip of claim 9, wherein the tongue member has as its apex a forward curved, longitudinally extending tip which defines a forward-most-leading portion of the clip.

11. The clip of claim 10, wherein the apex of the tongue member is configured to be received by the groove of the first course.

* * * * *